United States Patent [19]

Allee

[11] 4,094,162

[45] June 13, 1978

[54] METHOD FOR INSTALLING AN OFFSHORE TOWER

[75] Inventor: John W. Allee, Houston, Tex.

[73] Assignee: Brown & Root, Inc., Houston, Tex.

[21] Appl. No.: 808,520

[22] Filed: Jun. 21, 1977

[51] Int. Cl.[2] ..... E02B 17/00

[52] U.S. Cl. ..... 61/96

[58] Field of Search ..... 61/96, 97, 92, 91, 90, 61/88, 89; 254/105, 107

[56] References Cited

U.S. PATENT DOCUMENTS

| | | | |
|---|---|---|---|
| 2,574,140 | 11/1951 | Boschen | 61/96 |
| 2,930,200 | 3/1960 | Perkins | 61/91 |
| 3,007,317 | 11/1961 | Suderow | 61/91 |
| 3,381,482 | 5/1968 | Manning | 61/96 |

*Primary Examiner*—Jacob Shapiro
*Attorney, Agent, or Firm*—Kenway & Jenney

[57] ABSTRACT

A tower is installed at an offshore worksite by floating to the worksite a tower subassembly which comprises a base, a plurality of upright open-trussed initial leg segments, and a plurality of flotation tanks. A plurality of open-trussed add-on leg segments are stored on a vessel in the vicinity of the worksite. The flotation tanks are ballasted to partially immerse the subassembly so that buoyant jacking units disposed within and connected to respective ones of the initial leg segments floatingly support the subassembly, with top portions of the initial leg segments projecting above the water surface. Add-on leg segments are mounted onto the leg portions projecting above the water surface. While the subassembly is suspended from the jacking units, the subassembly is lowered so that the jacking units enter the add-on leg segments as the add-on leg segments pass downwardly therearound. These steps are repeated so that the subassembly is gradually built-up with leg segments and is progressively submerged. When the base is supported on the sea floor, the jacking units are lifted from the top ends of the tower legs. A work platform is then installed on the tower legs above the water surface.

6 Claims, 13 Drawing Figures

METHOD FOR INSTALLING AN OFFSHORE TOWER

BACKGROUND AND OBJECTS

This invention relates to methods for installing offshore tower structures.

Numerous sea-related activities, such as oil exploration and recovery operations, for example, are conducted from offshore platform or tower structures. Towers have been employed which rest in an upright condition upon the water bed and are of extensive height, i.e., towers higher than 400 feet have been heretofore utilized.

Problems of considerable magnitude have been experienced during the installation of mammouth offshore structures, giving rise to the proposal of various installation techniques, as demonstrated for example by the following U.S. Pat. Nos. 2,946,198, issued to Knapp on July 26, 1960; 3,633,369, issued to Lawrence on Jan. 11, 1972; 3,729,940, issued to Koehler on May 1, 1973; and French Pat. No. 1,444,839, issued May 31, 1966.

It has been proposed, for instance, to float an assembled tower in a horizontal position to an offshore worksite, upend the tower in the water and, thereafter, submerge the tower until its base rests upon the water bed.

It has also been proposed to float an assembled tower in upright fashion to the worksite and then gradually lower and immerse the tower onto the water bed.

It will be realized that massive pre-assembled towers, whether floated to a worksite in horizontal or upright positions, can be very difficult to support and maneuver, especially in rough seas. Moreover, the towers must be specially fabricated to withstand the high stress conditions occurring during transportation and immersion.

It has been suggested to install offshore structures by assembling component parts thereof at the worksite (see, for example, U.S. Pat. Nos. 2,534,480, issued to Shannon on Dec. 19, 1950 and 3,839,873, issued to Loire on Oct. 8, 1974.) Such techniques can be very time-consuming and may be hampered by unstable sea conditions, especially those involving structures which are highly susceptible to the effects of wave and wind action.

It is, therefore, an object of the present invention to eliminate or alleviate problems of the type previously discussed.

It is another object of the present invention to provide novel methods for installing offshore tower structures.

It is yet another object of the present invention to avoid subjecting offshore tower structures to high degrees of stress during installation.

It is a further object of the invention to support an immersed tower internally by means which can be subsequently removed.

It is still another object of the invention to provide novel methods and apparatus for the rapid on-site assembling of offshore tower components involving the use of removable buoyancy units which are floated within open-trussed legs of the tower and which are connectible to original leg segments and thereafter connectible to add-on leg segments of the tower to support the tower as it is gradually assembled and immersed.

BRIEF SUMMARY

These and other objects are achieved by the present invention in which a tower subassembly is floated to an offshore worksite. The subassembly comprises a base, a plurality of upright open-trussed initial leg segments, and a flotation tank arrangement. A plurality of open-trussed and add-on leg segments are stored on a vessel in the vicinity of the worksite. The flotation tanks are ballasted to partially immerse the subassembly so that buoyant jacking units disposed within and connected to respective ones of the initial leg segments floatingly support the subassembly, with top portions of the initial leg segments projecting above the water surface. Add-on leg segments are mounted onto the leg portions projecting above the water surface. While suspending the subassembly from the jacking units, the subassembly is lowered so that the jacking units enter the add-on leg segments as the add-on leg segments pass downwardly therearound. The tower subassembly is thereby gradually built-up with leg segments and becomes progressively submerged. These steps are repeated until the base is supported on the sea floor. The jacking units are then lifted from the top ends of the tower legs and a work platform is installed thereupon above the water surface.

THE DRAWING

Other objects and advantages of the present invention will become apparent from the subsequent detailed description thereof in connection with the accompanying drawings in which like numerals designate like elements, and in which.

DETAILED DESCRIPTION

Figure 1:
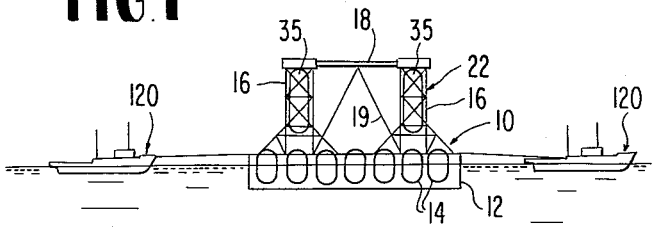
FIGS. 1 through 5 depict, in schematic side elevational view, a sequence of steps for assembling an offshore tower in accordance with the present invention.

A preferred technique for installing an offshore tower according to the present invention involves fabricating a base portion 10 (FIG. 1) of the tower at a suitable construction facility (not shown). The base 10 can be of any suitable skeletal framework design, such as the type disclosed in the aforementioned Koehler patent, and is adapted to carry a buoyant hull assembly 12. The buoyant hull assembly 12 includes a collar-like framework which extends around the periphery of the base 10 and supports a plurality of flotation tanks 14. These tanks can be selectively ballasted and deballasted by conventional equipment to establish suitable buoyancy for low draft flotation of the base 10.

Extending upwardly from the base are a plurality of leg segments 16 which are preassembled onto the base at the construction facility. The leg segments 16 are of suitable open-trussed construction. While four leg segments 16 are preferred, it will be realized that any number of legs suitable for supporting a platform under expected operating conditions may be employed. The leg segments 16 are suitably braced such as by horizontal bracing sections 18 and diagonal braces 19. Alternately, suitable X-bracing could be installed directly between the leg segments.

Figure 7:
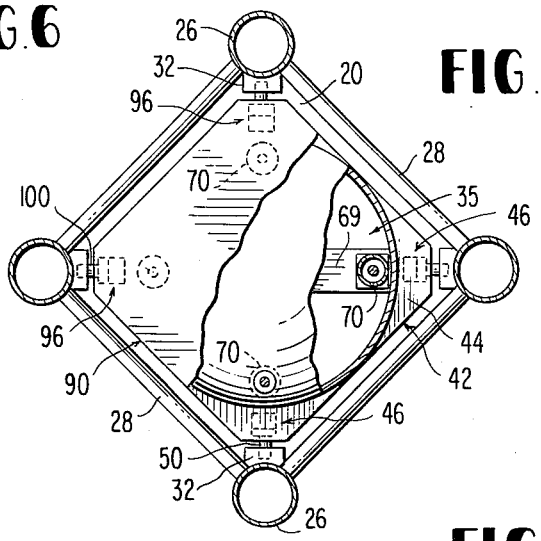
FIG. 7 is a cross-sectional view taken along line 7—7 of FIG. 6 depicting the jacking unit with portions thereof broken away.
Figure 8:
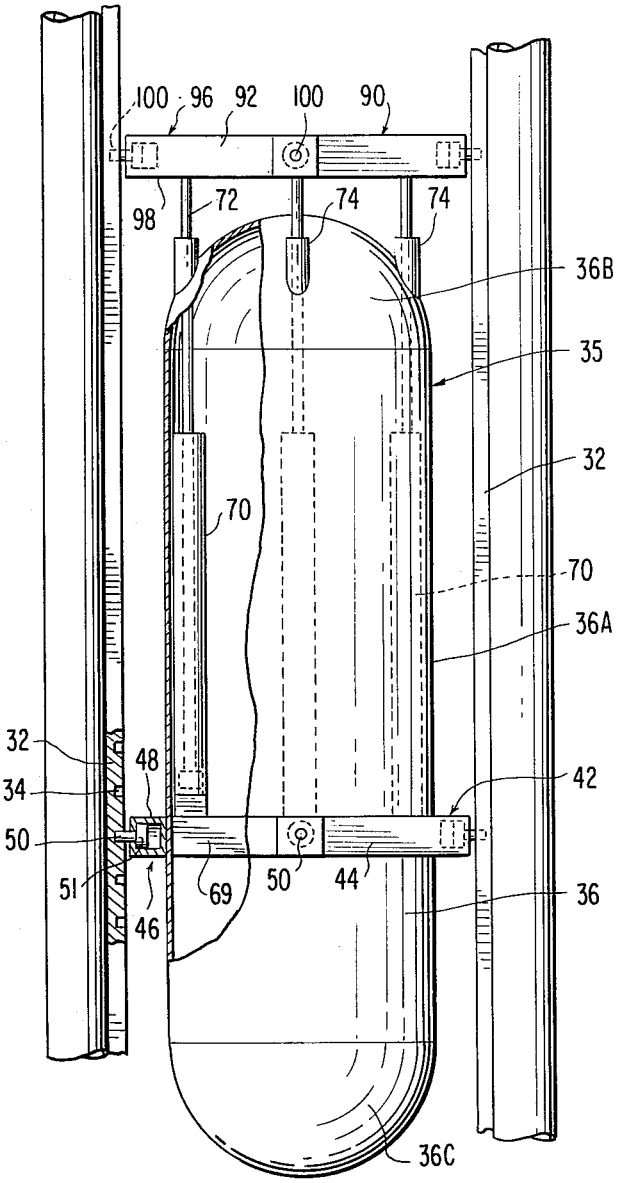
FIG. 8 is a side elevational view of the jacking mechanism according to the present invention with portions thereof broken away.

The leg segments 16 are each constructed so as to form an open, unobstructed interior 20 (FIG. 7). In this regard, the leg segments 16 may each comprise four cylindrical upright columns 26 interconnected by a network of horizontal and diagonal brace elements 28, 30. The brace elements 28, 30 extend between adjacent columns to form a rectangular framework when viewed in plan (FIG. 7), the framework defining the open, unobstructed interior 20. Rigidly fastened to each of the columns 26 and extending vertically along a portion thereof facing into the interior 20 is a beam 32 containing vertically spaced apertures 34 (FIG. 8). Each beam 32 faces inwardly toward another, opposite beam disposed on a diagonally opposed column 26 and bisects the angle formed by adjacent horizontal brace elements 28 when viewed in plan (FIG. 1).

There is thus prefabricated a floatable tower subassembly 22 comprising the base 10, the flotation structure 12, and the leg segments 16, with each leg segment 16 being adapted to receive a buoyant jacking unit 35.

Each buoyant jacking unit 35 comprises a large buoyancy tank 36 (FIG. 8). The tank 36 can be of any suitable configuration capable of being inserted within the unobstructed interior 20 of a leg segment 16 and able to travel vertically therewithin. As depicted in FIG. 8, the tank 36 comprises a cylindrical center portion 36A which is closed-off by semi-spherical upper and lower end caps 36B, 36C. The tank 36 contains a buoyant medium, such as pressurized gas and can be provided with gas fittings for regulating the internal buoyancy pressure.

Fixedly secured to each buoyancy tank 36, preferably at a location below its axial midpoint, is a lower locking mechanism 42. This lower locking mechanism 42 comprises generally a horizontally disposed housing 44 which encompasses the outer periphery of the cylindrical center portion 36C. The housing 44 can be of any suitable configuration but preferably corresponds to the cross-sectional shape of the leg segment 16, and is thus of rectangular cross section in the preferred embodiment.

At each corner of the housing 44, there is provided a lower locking pin assembly 46. Each locking pin assembly 46 comprises a hydraulic ram including a cylinder 48 in which a pin 50 is slidably disposed. The pin 50 is connected to a piston 51 which is slidably disposed in the cylinder 48. The ram is of the double-acting type and includes fittings for conducting hydraulic fluid to and from opposite ends of the cylinder to extend and retract the pin 50. The arrangement is such that with the tank 36 mounted within a leg of the tower, the locking pin assemblies 46 each face a corner of the leg and the pins 50 are able to enter the apertures 34 of the beams 32 when extended.

Mounted internally of the buoyancy tank 36 on beams 69 are a plurality of hydraulic jacks 70. These jacks 70 are disposed in an upright fashion and have their rod ends 72 extending vertically outwardly through tubular passages 74 in the upper end cap 36B of the buoyancy tank 36. Suitable hydraulic fittings are accessible externally of the tank 36 for conducting hydraulic working fluid to actuate the jacks 70. The tubular passages 74 can be suitably sealed to confine the buoyancy medium within the tank 36. If desired, the jacks 70 can be mounted exteriorly of the tank 36.

Carried by the rod ends 72 of the hydraulic jacks 70 is an upper locking mechanism 90. This upper locking mechanism 90 includes a rectangular frame 92 which is rigidly mounted to the rod ends 72. The frame 92 carries, at its corners, a plurality of upper locking pin assemblies 96. The upper locking pin assemblies 96 are similar to the lower locking pin assemblies 46 in that they each include a cylinder 98, extendible and retractible pins 100 and hydraulic fittings for conducting hydraulic fluid to and from the cylinder 98 to extend and retract the pin 100.

The upper locking pin assemblies 96 are superimposed relative to respective ones of the lower locking pin assemblies 46 so as to be located at the inner corners of the rectangular framework of the leg segments 16 and facing the beams 32. The apertures 34 of the beams 32 are located so as to receive the pins 50, 100 whenever they are extended. The vertical spacing between the various levels of apertures is such that the upper and lower pins 100, 50 can be extended into apertures 34 when the hydraulic jacks 70 are in fully retracted or extended conditions.

The jacking units 35 are preferably inserted into the leg segments 16 prior to floating of the subassembly 22 to the worksite. This is accomplished by lowering the jacking units into the leg segments 24, extending the jacking cylinders 70, and then extending all of the upper and lower locking pins 100, 50 into apertures 34 and thus into supportive engagement with the beams 32. The fittings of the pin cylinders 48, 98 can be closed-off to maintain the pins in extended positions. The jacking units are thereby suspended from the columns 26 during travel of the subassembly 22 to the worksite. Alternatively, the pins 50, 100 can be spring biased outwardly and hydraulically retractible. In this manner, it is merely necessary to relieve hydraulic pressure from the cylinders 48, 98 to connect the jacking unit 35 to the leg segments.

If desired, the jacking units can be transported to the worksite aboard a separate vessel and then inserted into the leg segments at the worksite.

A derrick barge 110 is floatingly situated at the worksite and carries a number of prefabricated, open-trussed, add-on leg segments 16A and add-on bracing sections 18A. The add-on leg segments 16A are similar to the original leg segments 16 and include apertured beams 34. the barge also carries hydraulic pumping and valving apparatus which is appropriately connected via hydraulic conduits to the upper and lower locking pin assemblies 96, 46 and the hydraulic jacks 70 for hydraulic actuation thereof from the barge. Alternatively, the hydraulic conduits can be connected to valving apparatus mounted on the subassembly 22, and having permanent connections to the cylinders 48, 98 so that the locking pin assemblies and the jacks 70 can be actuated from the subassembly 22.

Figure 2:
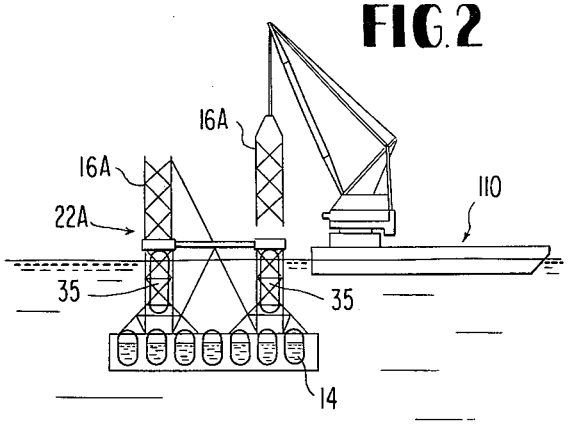

Once having been transported to the worksite, as by being towed or pushed by suitable power vessels 120, the subassembly 22 is immersed in the water. This is effected by ballasting the flotation tanks 14 to neutral buoyancy. Accordingly, the subassembly 22 sinks under its weight until buoyed by the buoyancy tanks 36, with the upper ends of the original leg segments 16 projecting above the water surface (FIG. 2).

Thereafter, the add-on leg segments 16A are placed onto the original leg segments 16 and are fixed in place, preferably by welding. Then, an add-on brace section 18A is transferred from the barge to the subassembly and is welded in place between the add-on leg segments 16A.

Connection between the leg segments 16, 16A is such that apertured beams 32 carried thereby are in continuous vertical alignment when the leg segments have been installed.

Figure 11:
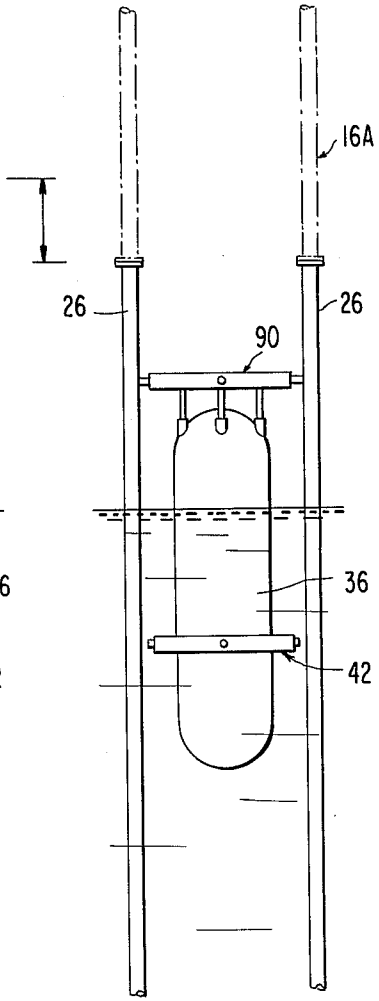
Figure 10:
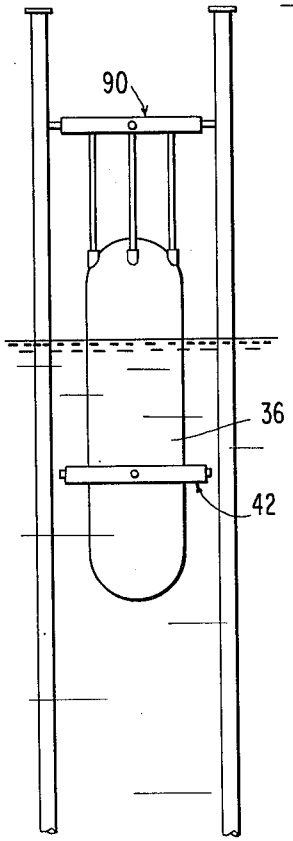

At this point, the enlarged subassembly 22A is allowed to sink a preselected incremental amount by retracting the lower locking pins 50 from the apertures 34 and relieving the hydraulic pressure on the piston ends of the jacks 70, of all of the jacking units 35. The weight of the tower subassembly acting downwardly upon the jacks 70 (through the pins 100) causes them to retract (FIGS. 10–11). At the end of the retraction stroke, i.e., when the jacks have been fully retracted and the tower subassembly has been lowered, the subassembly continues to be supported by the buoyancy tanks 36 which continually seek their own level in the water.

Figure 3:
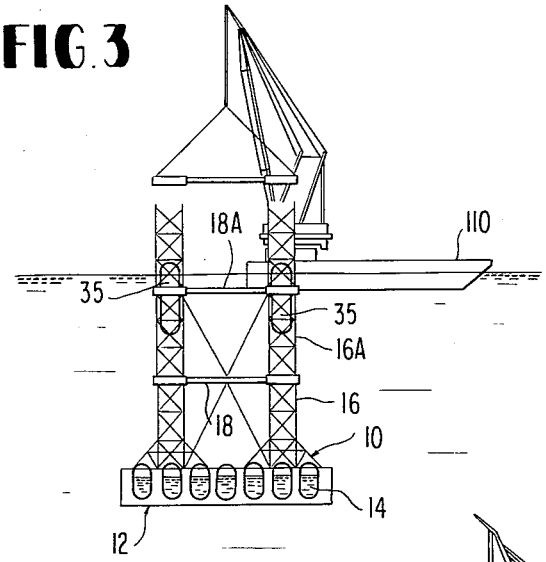
Figure 13:
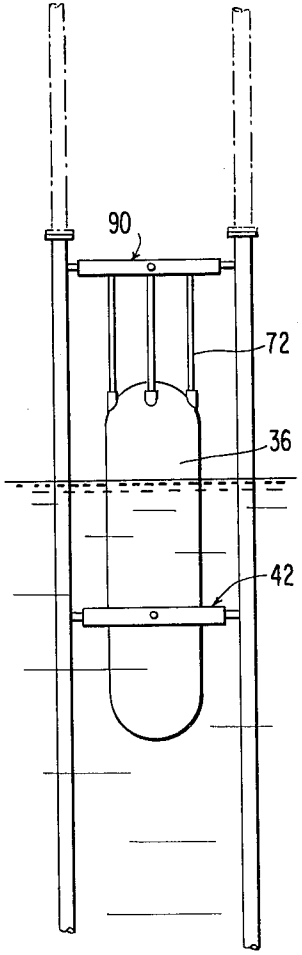
FIGS. 9 through 13 are schematic side elevational views depicting the sequential operation of a jacking unit according to the present invention.
Figure 12:
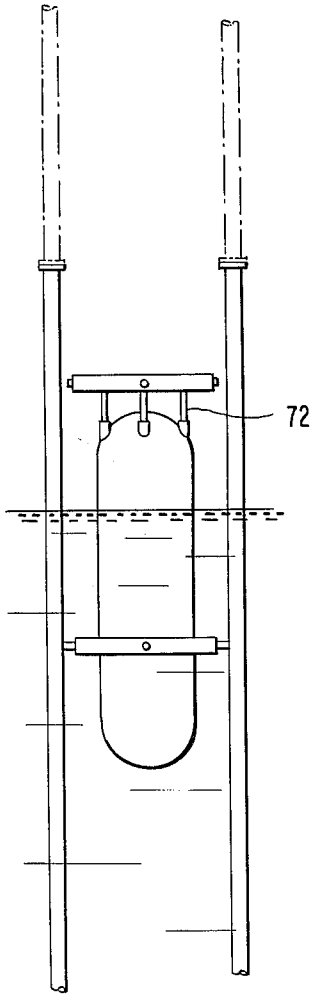

Thereafter, more add-on leg segments 16A and another bracing section 18A are installed onto the enlarged subassembly 22A (FIG. 3). Following this, the hydraulic system is actuated to extend the lower locking pins 50, retract the upper locking pins 100, and extend the jacks 70, of all of the jacking units 35 (FIGS. 12–13). When the jacks 70 have been fully extended, the upper locking pins 100 are extended (FIG. 13), and the previously described immersing procedure is repeated. That is, the lower locking pins 50 are retracted and the jacks 70 are bled to enable the jacks to be retracted by the weight of the subassembly. As before, the subassembly sinks by a distance equal to the stroke of the jacking cylinders 70. It will be realized that the rate of each incremental immersion can be controlled by regulating the rate of explusion of hydraulic fluid from the jacking cylinders 70, as by suitable valving.

As the tower is lowered, the jacking units eventually enter the add-on leg segments and are connected to the beams thereof.

Figure 4:
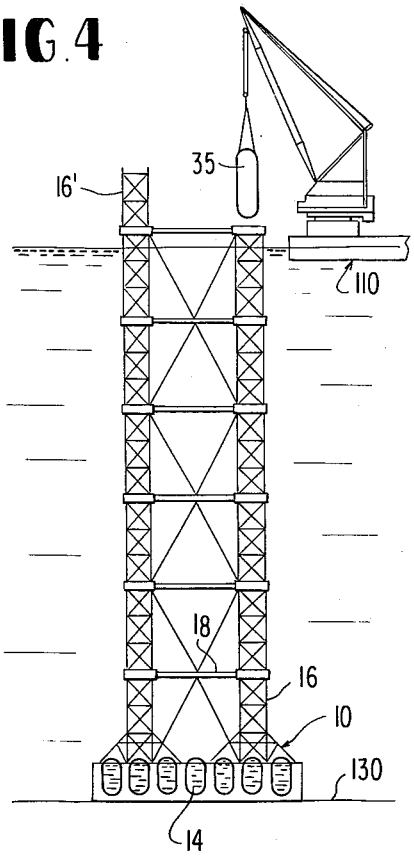
Figure 5:
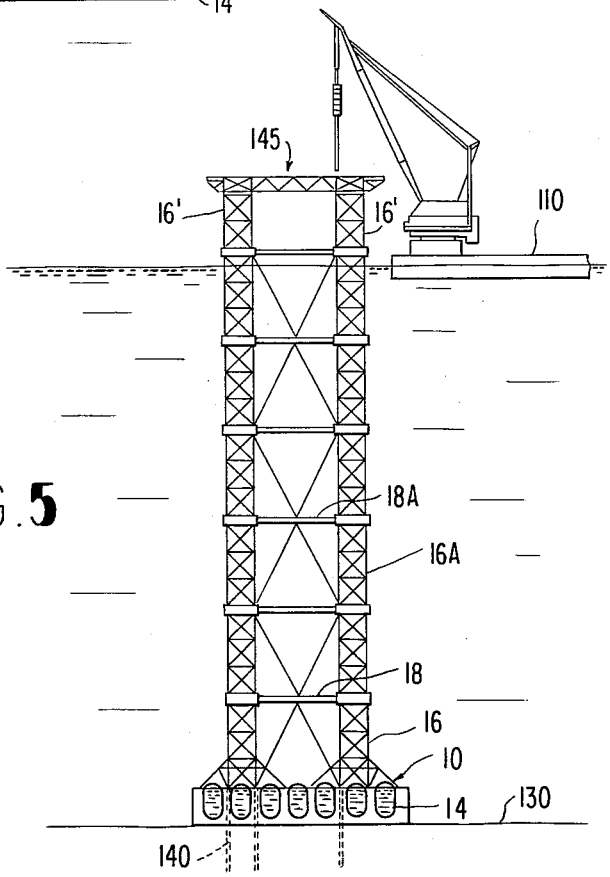

The above-described steps are repeated until the tower assembly is supported on the sea bed 130 (FIG. 4). At this point, the jacking units 35 are unlocked from the legs of the tower by retracting the pins 50, 100 and are lifted therefrom and deposited aboard the barge 110 where they can be transported elsewhere for further use. Also, the flotation tanks 14 are preferably fully ballasted at this point to augment the anchoring action.

Then the final leg segments 16' are installed and, if desired, piles 140 are inserted through the columns and hammered into the sea bed in the customary manner to anchor the tower.

Finally, a working platform 145 is installed onto the tower legs.

As an alternative step during the immersion of the tower, the various collar sections of the buoyant hull 12 carrying the flotation tanks 14 can be detached from the base 10 once the initial immersion of the subassembly 22 has taken place. Then the flotation tanks are deballasted, refloated, and transported elsewhere for reuse.

Figure 6:
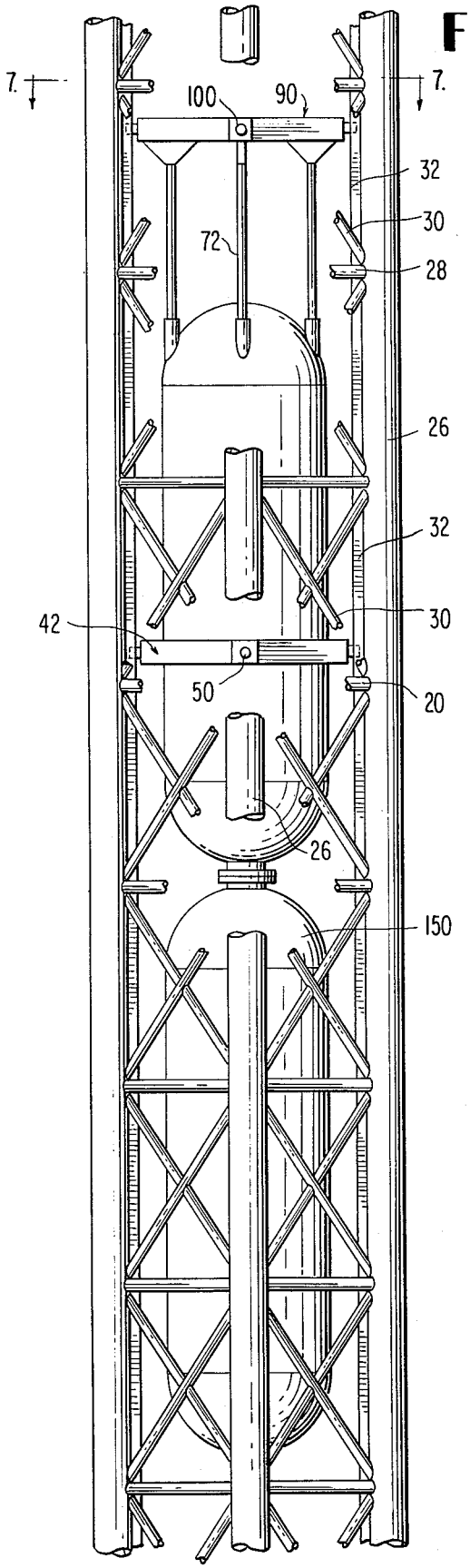
FIG. 6 is a side elevational view of a portion of a tower leg depicting a jacking unit according to the present invention.

The buoyancy tanks 36 may be initially pressurized sufficiently to support the tower subassemblies during the entire erection procedure. Alternatively, the pressurization of the tanks can be increased as assemblage progresses to compensate for the added weight. As a further alternative, one or more additional buoyancy tanks 36A can be initially connected to the tanks 36 to provide additional buoyancy, as illustrated in FIG. 6.

OPERATION

In operation, the subassembly 22 comprising the base 10, the initial leg segments 16, the flotation assembly 12, and the jacking units 35, is floated to the worksite (FIG. 1). The jacking units are supported within the leg segments 16 preferably above the water surface by engagement of the upper and lower pins 100, 50 within the apertured beams 32.

As assembly of the tower is to commence, add-on tower components 16A, 18A are floatingly carried by a support or derrick barge 110 in the vicinity of the worksite. Suitable hydraulic hook-ups are made from the barge to the cylinders 48, 98, 70.

Figure 9:
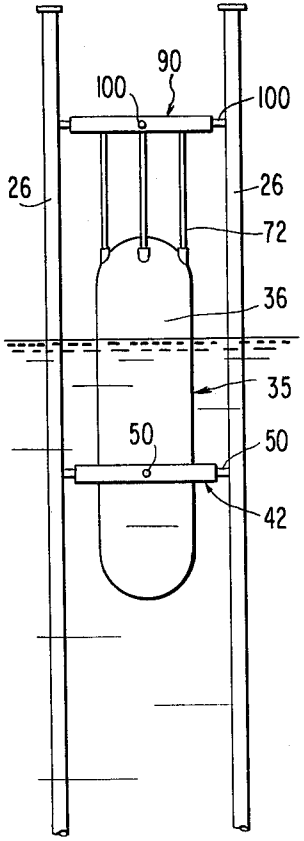

The assembling procedure is initiated by ballasting the flotation tanks 14 to neutral buoyancy to immerse the subassembly 22 until floatingly supported by buoyancy tanks 36 with portions of the initial segments 16 projecting above the water surface (FIG. 9). The flotation tanks 14 can be ballasted by manual actuation of suitable valving on the tanks 14 by divers.

Once the subassembly is in a proper floating state in the water, add-on leg segments 16A and brace members 18A are hoisted onto the tops of the initial leg segments 16 and are welded in place. Thereafter, the pins 50, 100 and jacking cylinders 70 are sequentially actuated so that the subassembly 22 is lowered from the buoyancy units 35. In this fashion, the buoyancy units 35 eventually enter the add-on leg segments and approach the upper levels thereof (FIG. 9). At this point, and as can be viewed from FIGS. 9 through 13, sequential actuation of the extended pins 50, 100 and extended cylinders 70 comprises releasing the lower pins 50, and bleeding the jacking cylinders 70 so that the subassembly sinks under its own weight for a distance equal to the stroke of the jacking cylinders 70, and the leg segments pass downwardly around the buoyancy units. Thereafter, more add-on leg segments 16A and brace elements 18A are installed. Then, with the lower pins 50 extended and the upper pins 100 retracted, the hydraulic cylinders 70 are extended. The upper pins 100 are then extended. This sequence is repeated until the tower engages the sea bed. The jacking units 35 are hoisted from the tops of the tower legs, and the final add-on leg segments 16' are installed. Piles 140 are inserted through the columns 26 and are driven into the sea bed. A work platform 135 is installed onto the final leg segments 16' to complete the tower.

SUMMARY OF MAJOR ADVANTAGES AND SCOPE OF THE INVENTION

The present invention enables a tower to be erected absent many of the previously encountered difficulties. That is, it is only necessary to transport a subassembly to the worksite, rather than a fully completed tower structure. The construction facilities thus need not be designed to accommodate a massive structure, as previously required. Also, transportation can be carried out at a faster rate with less danger.

During installation, the open-trussed construction of the tower leg segments minimizes the effects of wind and wave action on the structure so as to facilitate stable working conditions. Therefore, assemblage can be carried out at a faster rate and in a safer manner. Since there is no need to support or upend a massive preassembled tower structure, there are no excessive stresses placed on the tower. Hence, strength requirements of the tower according to the invention are not as severe.

The jacking units are disposed within the tower legs during installation, thereby minimizing the area and volume occupied by the tower structure. Moreover, the jacking units can be easily removed in one piece from the legs in a vertical direction, without requiring difficult maneuvering or dismembering.

The embodiment of the invention in which the flotation tanks can be removed following immersion of the subassembly is economical in that these tanks are salvaged and are reusable.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A method of installing a tower at a worksite in a body of water, comprising the steps of:

floating to the worksite a tower subassembly comprising a base, a plurality of upright, open-trussed initial leg segments and flotation means;

floatingly disposing open-trussed add-on leg segments in the vicinity of said worksite;

ballasting said flotation means to partially immerse said subassembly so that buoyant jacking units disposed within and connected to respective ones of said initial leg segments floatingly support said subassembly, with top portions of said initial leg segments projecting above the water surface;

mounting add-on leg segments onto said leg portions projecting above the water surface;

while suspending said subassembly from said jacking units, lowering said subassembly so that said jacking units enter said add-on leg segments as said add-on leg segments pass downwardly therearound;

repeating said mounting and lowering steps until said base is supported on the floor of the body of water;

lifting said jacking units from the top ends of said uppermost add-on leg segments; and installing a work platform thereupon above the water surface.

2. A method according to claim 1 wherein said floating step comprises floating said subassembly to the worksite while said jacking units are connected to and within said leg segments.

3. A method according to claim 1 wherein said subassembly is lowered by disconnecting one part of said jacking unit from its associated leg segment, connecting an extended portion of said jacking unit to said leg segment, and allowing said extended portion to retract under the weight of said subassembly so that said leg segment passes downwardly around said jacking unit.

4. A method according to claim 1 wherein each of said jacking units comprises a buoyancy tank, a plurality of hydraulically actuable first pins mounted for movement with said tank, a plurality of upright hydraulic jacks carried by said tank, and a plurality of hydraulically actuable second pins carried by extendible portions of said jacks, said lowering step comprising: maintaining said second pins extended into engagement with apertures in upright, inwardly facing beams carried by said leg segment, retracting said first pins from engagement with said beams, and bleeding said jacks to allow said subassembly to sink under its own weight by a distance equal to the stroke length of said jacks.

5. A method according to claim 1 wherein said unitial leg segments and said add-on leg segments carry tracks, said mounting step comprising mounting add-on leg segments onto said leg portions projecting above the water surface so that tracks carried thereby are aligned; said jacking units carrying power means engageable with said tracks; said lowering step comprising actuating said power means to allow said subassembly to sink under its own weight a predetermined distance.

6. A method of installing a tower at a worksite in a body of water comprising the steps of:

floating to the worksite a tower subassembly comprising a base, a plurality of upright, open-trussed initial leg segments, buoyant jacking units carried within said initial leg segments, and flotation tanks;

carrying a plurality of open-trussed add-on leg segments on a vessel at said worksite;

ballasting said flotation tanks to partially immerse said subassembly so that said buoyant jacking units floatingly support said subassembly with top portions of said initial leg segments projecting above the water surface;

mounting add-on leg segments onto said leg portions projecting above the water surface;

actuating power means mounted on said jacking units and connected to respective leg segments to allow said subassembly to sink a predetermined distance under its own weight so that said jacking units enter said add-on leg segments as said subassembly passes downwardly therearound;

repeating said mounting and actuating steps until said base engages the water bed;

hoisting said jacking units from the upper ends of the uppermost add-on leg segments; and installing a work platform thereupon above the water surface.

* * * * *